US009744760B2

(12) United States Patent
Yamada et al.

(10) Patent No.: US 9,744,760 B2
(45) Date of Patent: Aug. 29, 2017

(54) LIQUID EJECTION HEAD, RECORDING APPARATUS AND HEAT RADIATION METHOD FOR LIQUID EJECTION HEAD

(71) Applicant: CANON KABUSHIKI KAISHA, Tokyo (JP)

(72) Inventors: Kazuhiro Yamada, Yokohama (JP); Takuto Moriguchi, Kamakura (JP); Zentaro Tamenaga, Sagamihara (JP); Shuzo Iwanaga, Kawasaki (JP); Takatsugu Moriya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 14/615,960

(22) Filed: Feb. 6, 2015

(65) Prior Publication Data

US 2015/0239238 A1 Aug. 27, 2015

(30) Foreign Application Priority Data

Feb. 25, 2014 (JP) ..... 2014-034145

(51) Int. Cl.
*B41J 29/377* (2006.01)
*B41J 2/045* (2006.01)
(Continued)

(52) U.S. Cl.
CPC ..... *B41J 2/04528* (2013.01); *B41J 2/0458* (2013.01); *B41J 2/04563* (2013.01);
(Continued)

(58) Field of Classification Search
USPC ..... 347/18, 56; 29/620
See application file for complete search history.

(56) References Cited

U.S. PATENT DOCUMENTS 6,659,591 B2 12/2003 Sato et al.
7,625,072 B2 12/2009 Saito et al.
(Continued)

FOREIGN PATENT DOCUMENTS

CN 101444994 A 6/2009
CN 101607474 A 12/2009
(Continued)

OTHER PUBLICATIONS

Office Action issued in Chinese Patent Application No. 201510087837.9, dated Feb. 3, 2016.

*Primary Examiner* — Lam Nguyen
(74) *Attorney, Agent, or Firm* — Fitzpatrick, Cella, Harper & Scinto

(57) ABSTRACT

Provided is a liquid ejection head including: a plurality of recording element substrates including energy generating elements that generate ejection energy for ejecting liquid from ejection orifices; a first support member that supports the plurality of recording element substrates such that the recording element substrates are arranged in one or more lines on a main surface of the first support member; and a second support member that supports the first support member on a surface opposite to the main surface. A first thermal resistance concerning an in-plane direction parallel to the main surface, of a region between the recording element substrates in the first support member is higher than a second thermal resistance concerning a thickness direction of the second support member, of a projection region that overlaps with each recording element substrate in the second support member.

11 Claims, 11 Drawing Sheets

(51) Int. Cl.
*B41J 2/14* (2006.01)
*B41J 2/155* (2006.01)

(52) U.S. Cl.
CPC ..... *B41J 2/04581* (2013.01); *B41J 2/1408* (2013.01); *B41J 2/155* (2013.01); *B41J 2202/12* (2013.01); *B41J 2202/20* (2013.01)

(56) References Cited

U.S. PATENT DOCUMENTS

| | | | | |
|---|---|---|---|---|
| 7,980,676 | B2 | 7/2011 | Hirosawa et al. | |
| 8,141,988 | B2 | 3/2012 | Hirosawa | |
| 8,177,330 | B2 | 5/2012 | Suganuma et al. | |
| 8,926,067 | B2 | 1/2015 | Iwanaga et al. | |
| 9,254,658 | B2 | 2/2016 | Yamada et al. | |
| 2008/0273056 | A1 | 11/2008 | Nishikawa | |
| 2009/0141064 | A1* | 6/2009 | Shihoh | B41J 2/1408 347/18 |
| 2013/0155151 | A1 | 6/2013 | Otaka et al. | |
| 2015/0029265 | A1 | 1/2015 | Iwanaga et al. | |
| 2015/0085017 | A1 | 3/2015 | Yamada | |
| 2015/0085018 | A1 | 3/2015 | Yamada et al. | |

FOREIGN PATENT DOCUMENTS

| | | | |
|---|---|---|---|
| CN | 103240995 | A | 8/2013 |
| JP | 4999663 | B2 | 8/2012 |
| WO | 2013/191009 | A1 | 12/2013 |

* cited by examiner

LIQUID EJECTION HEAD, RECORDING APPARATUS AND HEAT RADIATION METHOD FOR LIQUID EJECTION HEAD

BACKGROUND OF THE INVENTION

Field of the Invention

The present invention relates to a liquid ejection head that ejects liquid, a recording apparatus including the liquid ejection head and a heat radiation method for the liquid ejection head.

Description of the Related Art

A so-called thermal method is known as a liquid ejection method for a liquid ejection head. In the thermal method, liquid is heated to be boiled, and the force of bubbles generated by the boiling is used to eject the liquid from ejection orifices. In recent years, in order to meet a demand for high-speed image recording, achievement of a thermal liquid ejection head having a large recording width is desired. An example of such a liquid ejection head is disclosed in Japanese Patent No. 4999663.

The liquid ejection head disclosed in Japanese Patent No. 4999663 includes: a plurality of recording element substrates including ejection orifice lines in which a plurality of ejection orifices is linearly arranged; and a support member that supports the plurality of recording element substrates such that the recording element substrates are arranged along an arrangement direction of the ejection orifices. In the liquid ejection head, because the plurality of recording element substrates is arranged along the arrangement direction of the ejection orifices, an ejection orifice line including a large number of the ejection orifices is formed, and the recording width is made larger by the ejection orifice line.

In the liquid ejection head disclosed in Japanese Patent No. 4999663, the plurality of recording element substrates is placed in one or more lines on the support member. Hence, part of heat that is generated in one recording element substrate when liquid is ejected can be transferred to another recording element substrate adjacent to the one recording element substrate through the support member. At this time, the heat in recording element substrates closer to the center of the line is less easily radiated, and hence these recording element substrates tend to come into a high-temperature state. Accordingly, in the liquid ejection head disclosed in Japanese Patent No. 4999663, a temperature difference between the recording element substrates can become larger along with the liquid ejection. If the temperature difference between the recording element substrates is large, a temperature difference between the liquids respectively existing in the recording element substrates is also large. If the temperature difference between the liquids is large, a viscosity difference between the liquids is also large. As a result, it is concerned that variations in the amount of ejected liquid are large, and may have influences on image quality.

SUMMARY OF THE INVENTION

In order to solve the above-mentioned problem, the present invention provides a liquid ejection head including: a plurality of recording element substrates including energy generating elements that generate ejection energy for ejecting liquid from ejection orifices; a first support member that supports the plurality of recording element substrates such that the recording element substrates are arranged in one or more lines on a main surface of the first support member; and a second support member that supports the first support member on a surface opposite to the main surface. A first thermal resistance concerning an in-plane direction parallel to the main surface, of a region between the recording element substrates in the first support member is higher than a second thermal resistance concerning a thickness direction of the second support member, of a projection region that overlaps with each recording element substrate in the second support member.

In order to solve the above-mentioned problem, the present invention further provides a heat radiation method for a liquid ejection head, including radiating heat generated in a plurality of recording element substrates including energy generating elements that generate ejection energy for ejecting liquid from ejection orifices, by means of: a first support member that supports the plurality of recording element substrates such that the recording element substrates are arranged in one or more lines on a main surface of the first support member; and a second support member that supports the first support member on a surface opposite to the main surface, the heat radiation method further including transferring the heat from the first support member to the second support member by making such setting that a first thermal resistance concerning an in-plane direction parallel to the main surface, of a region between the recording element substrates in the first support member is higher than a second thermal resistance concerning a thickness direction of the second support member, of a projection region that overlaps with each recording element substrate in the second support member.

In the present invention, because the first thermal resistance is higher than the second thermal resistance, the heat that is generated in each recording element substrate (each energy generating element) along with the liquid ejection and is transferred to the first support member is more transferred to the second support member located immediately therebelow than to the other recording element substrates. Hence, the heat conduction between the recording element substrates can be suppressed.

Further features of the present invention will become apparent from the following description of exemplary embodiments with reference to the attached drawings.

DESCRIPTION OF THE EMBODIMENTS

Preferred embodiments of the present invention will now be described in detail with reference to the attached drawings.

First Embodiment

Figure 1:
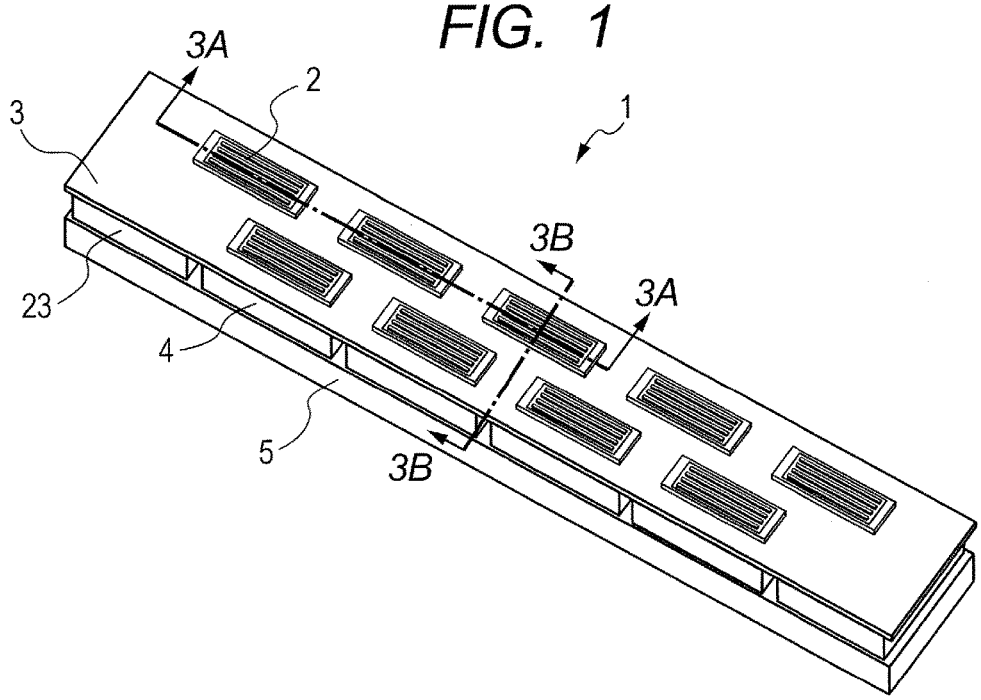
FIG. 1 is a perspective view of a liquid ejection head of a first embodiment.
Figure 2:
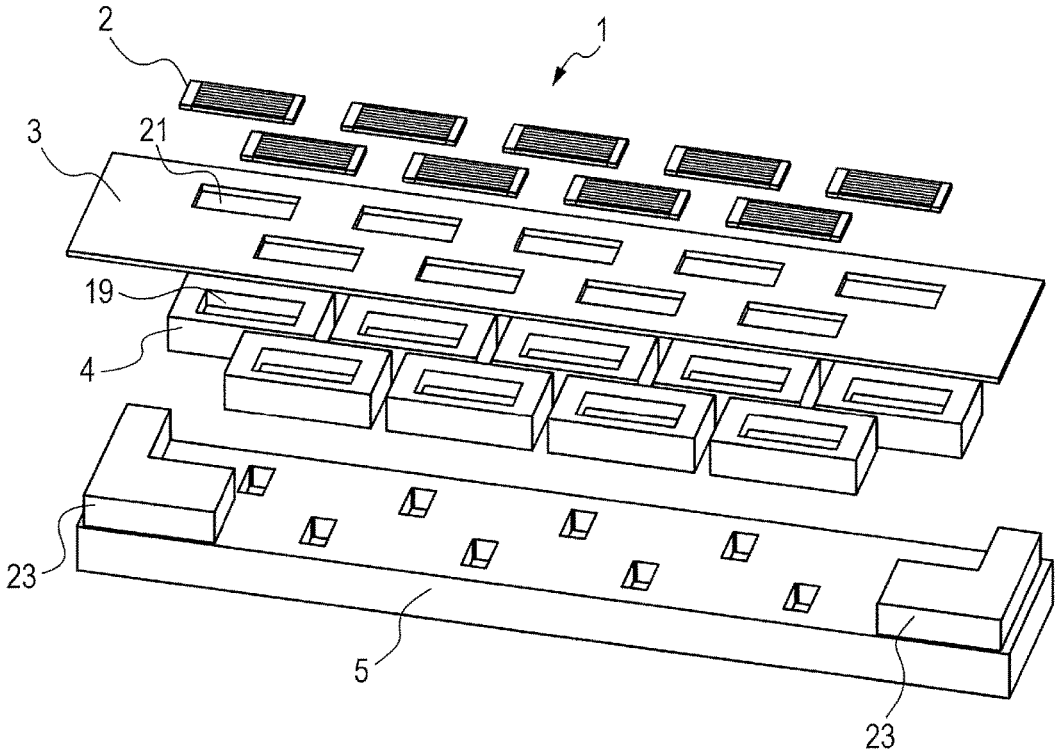
FIG. 2 is an exploded perspective view of the liquid ejection head illustrated in FIG. 1.

A first embodiment of the present invention is described. FIG. 1 is a perspective view of a liquid ejection head of the first embodiment. FIG. 2 is an exploded perspective view of the liquid ejection head illustrated in FIG. 1. A liquid ejection head 1 of the present embodiment illustrated in FIG. 1 and FIG. 2 includes a plurality of recording element substrates 2, a first support member 3 that supports the plurality of recording element substrates 2, a plurality of second support members 4 that supports the first support member 3, and a base substrate 5 that supports the plurality of second support members 4.

Figure 3A:
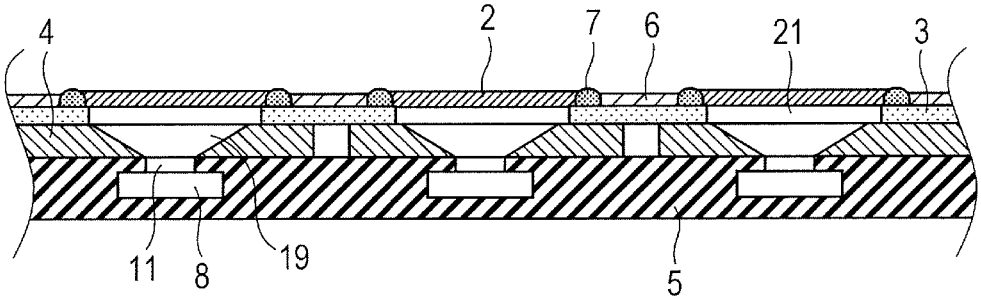
FIG. 3A is a cross-sectional view taken along a sectional line 3A-3A illustrated in FIG. 1.
Figure 3B:
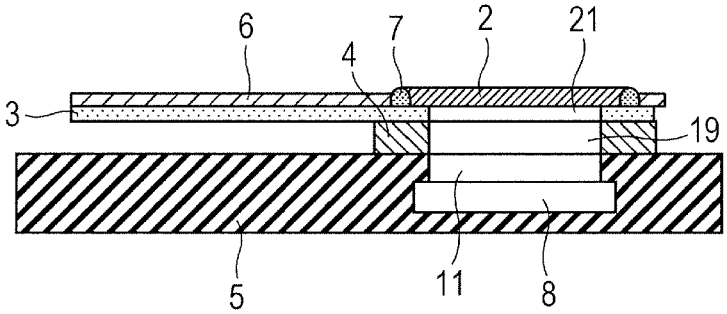
FIG. 3B is a cross-sectional view taken along a sectional line 3B-3B illustrated in FIG. 1.

FIG. 3A is a cross-sectional view taken along a sectional line 3A-3A illustrated in FIG. 1. FIG. 3B is a cross-sectional view taken along a sectional line 3B-3B illustrated in FIG. 1. Flexible printed circuits (hereinafter, referred to as FPC) 6 and sealants 7 illustrated in FIGS. 3A and 3B are omitted in FIGS. 1 and 2.

The plurality of recording element substrates 2 is arranged in one or more lines on the first support member 3. In the present embodiment, as illustrated in FIG. 1, the plurality of recording element substrates 2 is placed in a zig-zag manner. How to place the plurality of recording element substrates 2 is not limited to the zig-zag manner, and the plurality of recording element substrates 2 may be placed, for example, in a straight line. The FPC 6 is supported together with each recording element substrate 2 by the first support member 3 (see FIGS. 3A and 3B). The FPC 6 is placed around the recording element substrate 2. Respective electrodes (not illustrated) of the FPC 6 and the recording element substrate are electrically connected to each other by wire bonding. Ejection signals and power for a ejection operation are transmitted by the wire bonding from the main body of a recording apparatus in which the liquid ejection head 1 is set, to each recording element substrate 2 through the FPC 6. The wire bonding is sealed by the sealant 7.

Figure 4A:
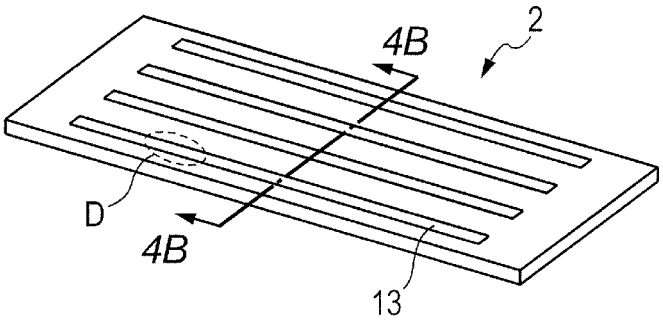
FIG. 4A is a diagram illustrating a structure of a recording element substrate 2.
Figure 4B:
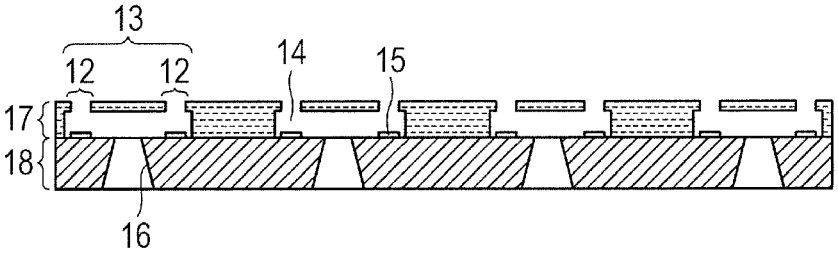
FIG. 4B is a cross-sectional view taken along a sectional line 4B-4B illustrated in FIG. 4A.
Figure 4C:
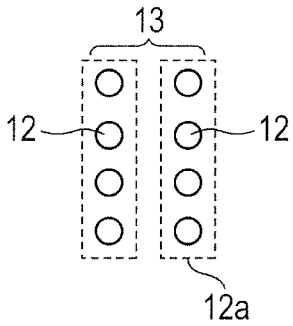
FIG. 4C is an enlarged view of a region D illustrated in FIG. 4A.

FIG. 4A is a perspective view of the recording element substrate 2. FIG. 4B is a cross-sectional view taken along a sectional line 4B-4B illustrated in FIG. 4A. FIG. 4C is an enlarged view of a region D illustrated in FIG. 4A. In the present embodiment, as illustrated in FIG. 4B, the recording element substrate 2 includes an ejection orifice forming member 17 and a substrate 18. A plurality of ejection orifices 12 for ejecting liquid and a plurality of bubble generation chambers 14 for generating bubbles in the liquid are formed in the ejection orifice forming member 17. In the present embodiment, the plurality of ejection orifices 12 forms one ejection orifice line 12*a*. Further, two ejection orifice lines 12*a* form one ejection orifice group 13 (see FIG. 4C). The substrate 18 includes: energy generating elements 15 that are positioned so as to be respectively opposed to the ejection orifices 12; and liquid supply orifices 16 that penetrate through the substrate 18. The energy generating elements 15 are arranged in lines similarly to the ejection orifices 12. Electric wiring (not illustrated) is formed inside of the substrate 18. The electric wiring is electrically connected to the electrode (not illustrated) of the FPC 6. If pulse voltage is input to the electric wiring through the electrode of the FPC 6, the energy generating elements 15 generate heat, and the liquid in the bubble generation chambers 14 boils. The liquid is ejected from the ejection orifices 12 by the force of bubbles generated by the boiling.

In the present embodiment, the outer shape of the recording element substrate 2 is a rectangle, but the present invention is not limited thereto. The outer shape of the recording element substrate 2 may be, for example, a parallelogram and a trapezoid.

Figure 5:
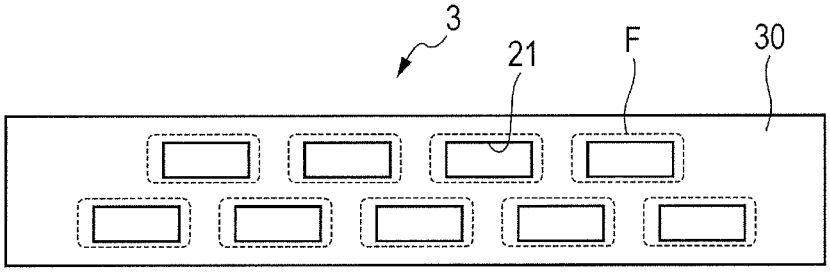
FIG. 5 is a top view of a first support member.

FIG. 5 is a plan view of the first support member 3. As illustrated in FIG. 5, the first support member 3 includes: a main surface 30 on which the plurality of recording element substrates 2 is arranged; and a plurality of through-holes 21 for respectively supplying the liquid to the recording element substrates 2. Each recording element substrate 2 is placed on the main surface 30 so as to cover each through-hole 21. The first support member 3 has a function of promoting heat transfer from each recording element substrate 2 to each second support member while suppressing heat transfer between the recording element substrates. This function enables a reduction in temperature difference between the recording element substrates caused along with liquid ejection. This function is described below.

Figure 6:
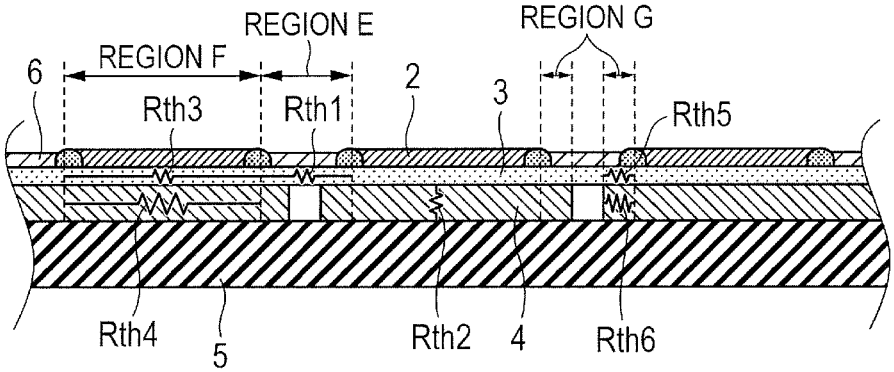
FIG. 6 is a diagram illustrating relations between thermal resistances in the first support member and a second support member.

In the present embodiment, the first support member 3 and the second support member 4 satisfy the following expression (1). FIG. 6 is a diagram for describing a relation in the following expression (1). FIG. 6 is a diagram in which a flow channel portion of the liquid is omitted from the cross-sectional view illustrated in FIG. 3A.

$$\text{Thermal Resistance } Rth1 > \text{Thermal Resistance } Rth2 \quad (1)$$

In the above expression (1), the thermal resistance Rth1 (first thermal resistance) is a thermal resistance concerning the in-plane direction parallel to the main surface 30, of a region E between the recording element substrates (see FIG. 6) in the first support member 3. The thermal resistance Rth2 (second thermal resistance) is a thermal resistance concerning the thickness direction of the second support member 4, of a projection region F that overlaps with each recording element substrate 2 in the second support member 4. If the relation in the above expression (1) is satisfied, most of the heat transferred from each recording element substrate 2 to the first support member 3 is radiated to the base substrate 5 through not the region E between the recording element substrates but the second support member 4. Accordingly, heat conduction between the recording element substrates adjacent to each other is suppressed, and hence the temperature difference between the recording element substrates is suppressed. In particular, in the case where liquid droplets small in volume are ejected in order to achieve high image quality, the ejection efficiency (liquid droplet volume/consumed power) is generally low, and the amount of heat that does not contribute to the liquid ejection is large. Hence, the amount of heat transferred from each recording element substrate 2 to the first support member 3 is large. Under the circumstance, if the relation in the above expression (1) is satisfied, the heat conduction between the recording element substrates can be suppressed, and the temperature difference between the recording element substrates can be reduced.

In the present embodiment, the first support member 3 and the second support member 4 can also satisfy the following expressions (2) and (3).

$$\text{Thermal Resistance } Rth3 < \text{Thermal Resistance } Rth4 \quad (2)$$

$$\text{Contact Area } S1 > \text{Contact Area } S2 \quad (3)$$

In the above expression (2), the thermal resistance Rth3 (third thermal resistance) is a thermal resistance concerning the in-plane direction, of the projection region F in the first support member 3 (see FIG. 6). The thermal resistance Rth4 (fourth thermal resistance) is a thermal resistance concerning the in-plane direction, of the projection region F in the second support member 4 (see FIG. 6). In the above expression (3), the contact area S1 is a contact area between the first support member 3 and each second support member 4. The contact area S2 is a contact area between the first support member 3 and each recording element substrate 2.

If the relation in the above expression (2) is satisfied, the heat generated in each recording element substrate 2 is mainly diffused in the in-plane direction in the first support member 3 to be transferred to the second support member 4. If the relation in the above expression (3) is satisfied, the heat transfer area between the first support member 3 and the second support member 4 is larger than the heat transfer area between the recording element substrate 2 and the first support member 3. Hence, the first support member 3 functions as a heat spreader. This function enables the heat to be easily transferred from the recording element substrate 2 to the second support member through the first support member 3. Hence, the temperature of the recording element substrate 2 that generates the heat along with the liquid ejection can be lowered.

As a conceivable method for lowering the temperature of the recording element substrate 2 in which the energy generating elements 15 generate heat, there may be mentioned a method including the steps of changing the thickness and the heat transfer area of the second support member 4; and adjusting the thermal resistance from the recording element substrate 2 to the base substrate 5. The second support member however includes an individual liquid chamber 19 as illustrated in FIG. 2 and FIGS. 3A and 3B. The individual liquid chamber 19 is a liquid chamber for distributing the liquid supplied from the base member 5 to each recording element substrate. Hence, the shape of the second support member needs to be designed also considering bubble releasability. Moreover, although the liquid ejection head 1 of the present embodiment is configured for monochrome recording, in order to configure a liquid ejection head for color recording, a plurality of complicated distribution paths needs to be provided in the second support member 4, and this places restrictions on processing. From these perspectives, the thickness and the heat transfer area of the second support member 4 cannot be designed in favor of only the heat radiation performance. Fortunately, the heat radiation performance of the second support member 4 can be enhanced by using the first support member 3 of the present embodiment, and hence restrictions on the design of the second support member 4 can be eased.

The material of the first support member 3 can have a modulus of elasticity (Young's modulus) higher than the modulus of elasticity of the second support member 4, can be low in linear expansion coefficient, and can be resistant to corrosion by liquid (for example, ink). Further, in the liquid ejection head 1 of the present embodiment, thermal stress of the FPC 6 acts on the recording element substrate 2 through the sealant 7, and hence the thermal stress may influence the accuracy in relative position between the recording element substrates. In order to suppress this influence, the material of the first support member 3 can have a higher modulus of elasticity and a lower linear expansion coefficient than those of the FPC 6. Specific examples of the material of the first support member 3 include titanium, alumina, and SiC.

Figure 7:
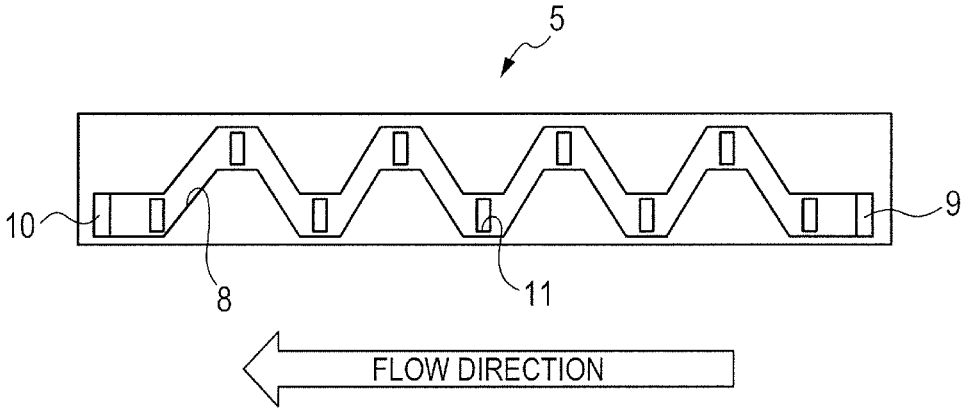
FIG. 7 is a top view of a base substrate.

FIG. 7 is a top view of the base substrate 5. FIG. 7 illustrates the inside of the base substrate 5 in a see-through manner. As illustrated in FIG. 7, a common flow channel 8 is formed inside of the base substrate 5. An inlet 9, an outlet 10 and liquid chamber communication ports 11 are formed in the common flow channel 8. Liquid flows into the inlet 9 from a liquid supply mechanism to be described later. The liquid that has flown into the inlet 9 flows through the common flow channel 8 to flow out from one of the outlet 10 and the liquid chamber communication ports 11. The outlet 10 is communicated with the liquid supply mechanism to be described later. Each liquid chamber communication port 11 is communicated with the individual liquid chamber 19. Assist plates 23 are respectively placed at both ends of the base substrate 5 (see FIGS. 1 and 2). The height of each assist plate 23 is the same as the height of each second support member 4. The assist plates 23 assist the second support members 4 to support the first support member 3.

Figure 8:
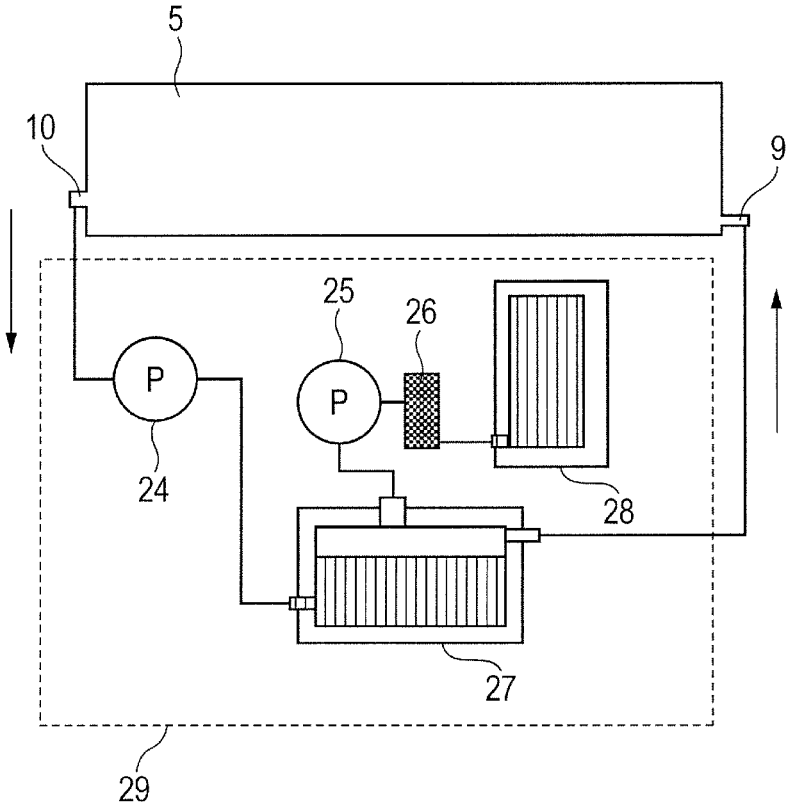
FIG. 8 is a diagram for describing a liquid supply mechanism.

FIG. 8 is a diagram for describing the liquid supply mechanism connected to the base substrate illustrated in FIG. 7. A liquid supply mechanism 29 illustrated in FIG. 8 includes a circulation pump 24, a supply pump 25, a filter 26, a tank 27 and a tank 28. The tank 27 is connected to the inlet 9 of the base substrate 5. The circulation pump 24 is connected to the outlet 10 of the base substrate 5. The circulation pump 24 is connected also to the tank 27, and liquid is circulated between the tank 27 and the liquid ejection head 1. The tank 27 is coupled to a heat exchanger (not illustrated) in a heat-exchangeable manner, whereby the temperature of the liquid that flows back to the tank 27 through the circulation pump 24 is kept constant. The tank 27 is connected also to the supply pump 25. The supply pump 25 feeds an amount of liquid from the tank 28 to the tank 27, the amount being the same as the amount of liquid ejected from the liquid ejection head 1. The filter 26 is provided between the tank 28 and the supply pump 25. Foreign substances are removed from the liquid by the filter 26. In the liquid supply mechanism 29, the circulation pump 24 circulates the liquid between the liquid ejection head 1 and the tank 27 during driving of the liquid ejection head 1.

As a result, the temperature of the liquid supplied to the liquid ejection head 1 is kept constant.

The liquid that is supplied from the liquid supply mechanism 29 to the base substrate 5 passes through the individual liquid chamber 19 of each second support member 4 and each through-hole 21 of the first support member 3 to be supplied to each recording element substrate 2. Then, the liquid is ejected from the ejection orifices along with heat generation by the energy generating elements 15. At this time, in the liquid ejection head 1 of the present embodiment, the thermal resistance Rth1 concerning the in-plane direction, of the region E between the recording element substrates in the first support member 3 is higher than the thermal resistance Rth2 concerning the thickness direction, of the projection region F in the second support member 4 (see the expression (1)). Hence, when the heat that is generated in the energy generating elements 15 for the liquid ejection is transferred to the first support member 3, the heat is promoted to be transferred to the second support member 4. This suppresses the heat conduction between the recording element substrates, and thus reduces the temperature difference between the recording element substrates caused along with the liquid ejection.

In the liquid ejection head 1 of the present embodiment, in order to satisfy the relation in the above expression (1) (increase the thermal resistance concerning the in-plane direction, of the region E between the recording element substrates), the thickness of the first support member 3*a* is made as small as possible. In the present invention, how to satisfy the relation in the above expression (1) is not limited thereto.

Figure 9:
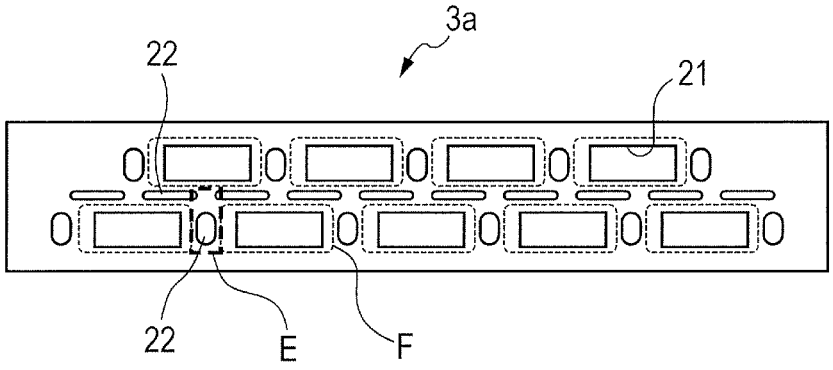
FIG. 9 is a top view illustrating another mode of the first support member.

FIG. 9 is a top view illustrating another mode of the first support member 3. In the present invention, as illustrated in FIG. 9, a first support member 3*a* may be used, and the first support member 3*a* is provided with hole parts 22 that are respective through-holes in the regions E between the recording element substrates. In this structure, heat transferred from the recording element substrates 2 to the first support member 3*a* is diffused to the vicinities of the hole parts 22, and then is transferred to the second support members 4. In this way, the heat transfer between the recording element substrates is suppressed by the hole parts 22, and hence the temperature difference between the recording element substrates can be reduced. The heat transfer between the recording element substrates is further suppressed by providing the hole parts 22. Hence, the thickness of the first support member can be made larger, the thermal resistance concerning the in-plane direction, of the region E between the recording element substrates can be lowered, and a heat spreading effect can be promoted.

Figure 10A:
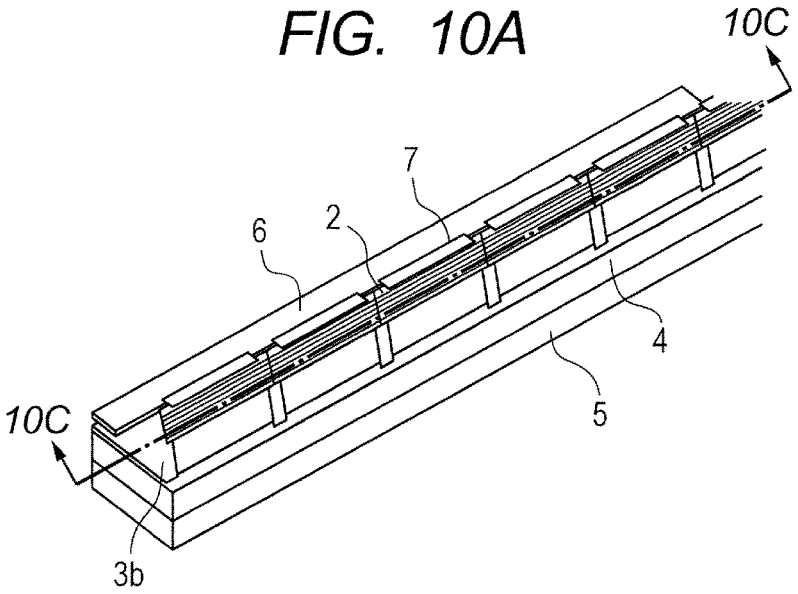
FIG. 10A is a perspective view of a liquid ejection head according to still another mode of the support member.
Figure 10B:
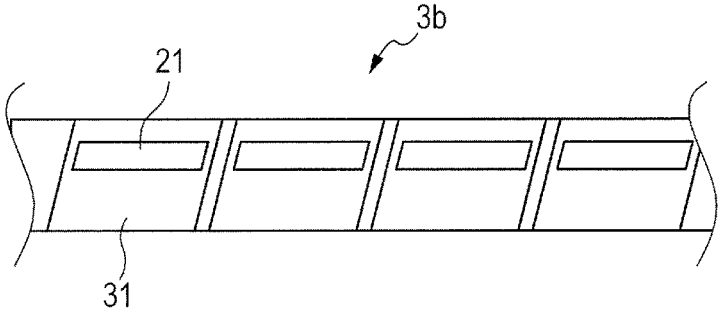
FIG. 10B is part of a top view of a first support member provided in FIG. 10A.
Figure 10C:
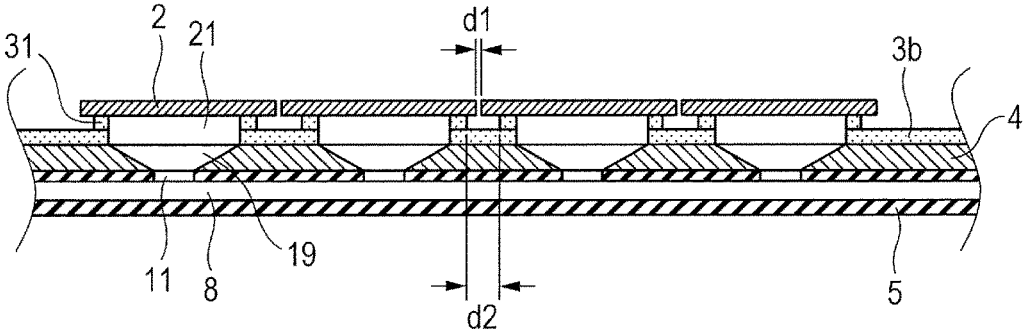
FIG. 10C is part of a cross-sectional view taken along a sectional line 10C-10C illustrated in FIG. 10A.

FIG. 10A is a perspective view of a liquid ejection head according to still another mode of the support member. FIG. 10B is part of a top view of a first support member provided in FIG. 10A. FIG. 10C is part of a cross-sectional view taken along a sectional line 10C-10C illustrated in FIG. 10A. The liquid ejection head illustrated in FIG. 10A has an arrangement (so-called in-line arrangement) in which the plurality of recording element substrates 2 is arranged in a straight line. A distance d1 (see FIG. 10C) between the recording element substrates is smaller in the in-line arrangement than in the zig-zag arrangement illustrated in FIG. 1. Hence, it is necessary to take countermeasures to suppress the heat transfer between the recording element substrates. In view of this, in the case of the in-line arrangement, a first support member 3*b* may be used, and the first support member 3*b* is provided with a plurality of pedestal parts 31 for individually mounting the plurality of recording element substrates 2 (see FIGS. 10B and 10C). In the present embodiment, each pedestal part 31 is provided such that a distance d2 between the pedestal parts is larger than the distance d1 between the recording element substrates (see FIG. 10C). In such a structure, a large distance can be secured between the recording element substrates in the first support member 3*b* while the recording element substrates are placed with a small distance therebetween. As a result, the relation in the above expression (1) can be satisfied, and hence the heat transfer between the recording element substrates can be suppressed. Note that, in the case of the in-line arrangement illustrated in FIG. 10A, a region for heat diffusion in the first support member 3*b* spreads in the direction orthogonal to the arrangement direction of the recording element substrates 2. Hence, the first support member 3*b* effectively functions as a heat spreader.

In the liquid ejection head 1 of the present embodiment, if the relations in the above expressions (2) and (3) are satisfied, the first support member 3 functions as a heat spreader. Hence, the temperature of the recording element substrate 2 in which the energy generating elements 15 generate heat can be effectively lowered. In the present embodiment, the following expression (4) can be further satisfied for a region G (see FIG. 6) obtained by excluding the projection region F from a region in which the first support member 3 and each second support member 4 overlap with each other.

$$\text{Thermal Resistance } Rth5 < \text{Thermal Resistance } Rth6 \quad (4)$$

In the above expression (4), the thermal resistance Rth5 (fifth thermal resistance) is a thermal resistance concerning the in-plane direction of the first support member 3, of the region G (see FIG. 6). The thermal resistance Rth6 is a thermal resistance concerning the in-plane direction of the second support member 4, of the region G (see FIG. 6). If the relation in the above expression (4) is satisfied, even part of the region E between the recording element substrates in the first support member 3 can produce a heat spreading effect, and hence the temperature of the recording element substrate 2 can be further lowered.

In the liquid ejection head 1 of the present embodiment, each second support member 4 that supports the first support member 3 on a surface opposite to the main surface 30 has a heat insulating function of preventing the heat generated in each recording element substrate 2 from being easily transferred to the liquid flowing through the common flow channel 8 of the base substrate 5. The heat insulating function suppresses the liquid temperature difference between the recording element substrate 2 located on the upstream side and the recording element substrate 2 located on the downstream side in the common flow channel 8. Further, due to the heat insulating function of the second support member 4, the heat generated in the recording element substrate 2 is more easily transferred to the ejected liquid. Hence, even if the amount of heat generated in the recording element substrate 2 becomes larger during the liquid ejection (recording), the amount of heat transferred to the liquid flowing through the common flow channel 8 is suppressed, and hence the heat exchange capacity and the consumed power of a cooler for cooling the liquid can be reduced.

The heat conductivity and the thickness of each second support member 4 and the shape of each individual liquid chamber 19 can be determined depending on the amount of heat transferred from each recording element substrate 2 to the liquid in the common flow channel 8. For example, in the case where the number of the recording element substrates 2 communicated with the common flow channels 8 is relatively large, a larger amount of heat is transferred from the recording element substrates 2 to the liquid in the common flow channel 8. Hence, the temperature of the liquid becomes higher toward the downstream side in the common flow channel 8, so that a liquid temperature difference occurs. In order to suppress the temperature difference, the thickness of the second support member 4 can be made larger, and the inside of the second support member 4 can be provided with a hollow part. The material of the second support member 4 can be a material having a relatively small linear expansion coefficient difference from the first support member 3 and the base substrate 5. The reason for this is as follows. The recording element substrate 2 in operation generates heat. The heat generated in the recording element substrate 2 is transferred to the first support member 3 and the second support member 4, whereby the first support member 3 and the second support member 4 thermally expand. In particular, in the case where each of the first support member 3, the second support member 4 and the base member 5 is long as in the present embodiment, if the linear expansion coefficient difference between: the first support member 3 and the base substrate 5; and the second support member 4 is large, a joint part of the second support member 4 may break. In the present embodiment, the individual liquid chamber 19 is formed in the second support member 4. Hence, if a joint part between the second support member 4 and another member breaks, the liquid may leak. If the second support member 4 is formed using a material having a relatively small linear expansion coefficient difference from the first support member 3 and the base substrate 5, the joint part between the second support member 4 and another member breaks less easily, and the leakage of the liquid is prevented. Examples of the material of the second support member 4 can include a composite material obtained by adding inorganic filler such as silica microparticles to a resin material as a base material. Particular examples of the resin material can include polyphenylene sulfide (hereinafter, referred to as PPS) and polysulfone (hereinafter, referred to as PSF).

In the liquid ejection head 1 of the present embodiment, in order to prevent breakage of a joint part between the first support member 3 and each second support member 4 and downsize the joint part, one second support member 4 is provided for one recording element substrate 2. The downsizing of the second support member 4 leads to a reduction in the amount of thermal expansion of the second support member 4, and the joint part to the first support member 3 breaks less easily. In the case where the linear expansion coefficient difference between the first support member 3 and the second support member 4 is sufficiently small, one second support member 4 may be provided for a plurality of the recording element substrates 2.

The base substrate 5 can be stiff enough not to cause warpage of the liquid ejection head 1. The material of the base substrate 5 can be sufficiently resistant to corrosion by liquid (for example, ink), can be low in linear expansion coefficient, and can be high in heat conductivity. If the heat conductivity of the base substrate 5 is high, the temperature of the liquid in the common flow channel 8 can be uniform. Hence, the liquid temperature difference between the upstream side and the downstream side in the common flow channel 8 is small. Examples of the material having such characteristics as described above can include a composite material obtained by adding inorganic filler such as silica microparticles to one of alumina and a resin material as a base material. Examples of the resin material can include PPS and PSF.

Second Embodiment

Figure 11:
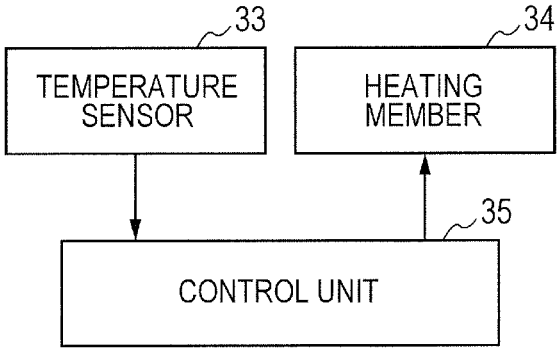
FIG. 11 is a block diagram illustrating a configuration of a main part of a liquid ejection head of a second embodiment.

A second embodiment of the present invention is described. Hereinafter, differences from the first embodiment are mainly described. FIG. 11 is a block diagram illustrating a configuration of a main part of a liquid ejection head of the second embodiment. The liquid ejection head of the present embodiment includes: a temperature sensor 33 that detects the temperature of each recording element substrate 2; and a heating member 34 that heats the recording element substrate 2. A control unit 35 is provided to a recording apparatus main body electrically connected to the recording element substrates 2, and the control unit 35 controls an operation of the heating member 34 based on an output value from the temperature sensor 33. In the present embodiment, the temperature sensor 33 and the heating member 34 are provided to the substrate 18 (see FIG. 4B) of each recording element substrate 2. The temperature sensor 33 and the heating member 34 are provided between the liquid supply ports 16 in the substrate 18. The number of the temperature sensors 33 and the number of the heating members 34 may be one or more.

The control unit 35 controls the operation of the heating member 34 such that the temperature of the temperature sensor 33 in a period (non-recording period) in which liquid is not ejected from the ejection orifices 12 falls within a predetermined allowable range. The upper limit of the allowable range can be set to a value obtained by subtracting a temperature difference that does not become a problem in terms of image quality, from an equilibrium temperature that the recording element substrate 2 reaches when the liquid continues to be ejected at the maximum duty (100%). If this upper limit is high, in the case where waiting time is prolonged, the temperature of the liquid in the head is raised by heating of the heating member 34. Consequently, when the liquid ejection (recording) is restarted, the liquid having the raised temperature is supplied to the recording element substrate. Hence, the temperature of the recording element substrate 2 temporarily rises up to a temperature equal to or higher than the equilibrium temperature, and the volume of each ejected liquid droplet becomes larger. As a result, image unevenness may occur, and a trouble may occur in the liquid ejection operation.

The first support member 3 used in the liquid ejection head 1 of the first embodiment has a high thermal resistance in the region E between the recording element substrates, in order to suppress the heat transfer between the recording element substrates. Hence, the recording element substrate 2 during the liquid ejection operation (hereinafter, referred to as driven recording element substrate) comes into a high-temperature state. On the other hand, the recording element substrate 2 that is not performing the liquid ejection operation (hereinafter, referred to as non-driven recording element substrate) is held in a low-temperature state. Hence, the temperature difference between the driven recording element substrate and the non-driven recording element substrate is large. In view of this, in the liquid ejection head of the present embodiment, the control unit 35 controls the heating operation of the heating member 34 based on the temperature detected by the temperature sensor 33, whereby the temperature difference between the driven recording element substrate and the non-driven recording element substrate can be held within a given range.

Figure 12:
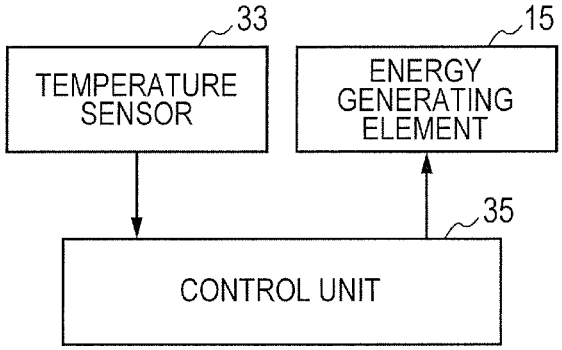
FIG. 12 is a block diagram illustrating a modified example of the liquid ejection head of the second embodiment.

As a configuration illustrated in FIG. 12, the liquid ejection head of the present embodiment may not include the heating member 34. In this configuration, the control unit 35 supplies electric power with which the liquid is not ejected, to the energy generating elements 15 of the non-driven recording element substrate, whereby the temperature difference from the driven recording element substrate can be held within a given range.

Third Embodiment

Figure 13A:
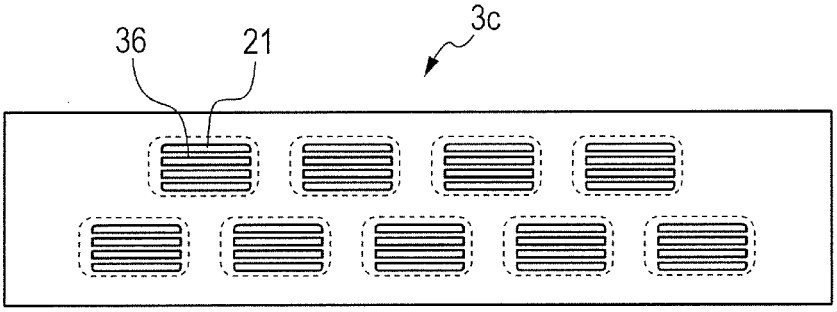
FIG. 13A is a top view of a first support member 3*c* provided to a liquid ejection head of a third embodiment.
Figure 13B:
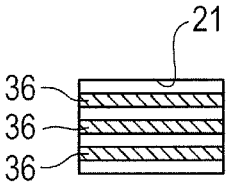
FIG. 13B is an enlarged view of a portion around a through-hole 21 in the first support member 3*c* illustrated in FIG. 13A.

A third embodiment of the present invention is described. Hereinafter, differences from the first embodiment are mainly described. FIG. 13A is a top view of a first support member 3*c* provided to a liquid ejection head of the third embodiment. FIG. 13A is a top view illustrating the entirety of the first support member 3*c* of the third embodiment. FIG. 13B is an enlarged view of a portion around a through-hole 21 in the first support member 3*c* illustrated in FIG. 13A.

As illustrated in FIG. 13A, the first support member 3*c* of the present embodiment includes beam parts 36 that extend across each through-hole 21. In the present embodiment, three beam parts 36 are provided, but the number of the beam parts 36 is not particularly limited.

The beam parts 36 are members for reducing a temperature difference inside of each recording element substrate 2 caused along with the liquid ejection. For example, in a ejection mode in which only a particular ejection orifice line 12 of the ejection orifice lines 12 (see FIG. 4C) of the recording element substrate 2 ejects liquid, the energy generating elements 15 that continue to generate heat and the energy generating elements 15 that generate no heat exist in the recording element substrate 2. This may cause a temperature difference inside of the recording element substrate 2. In this regard, in the present embodiment, the beam parts 36 function as heat averaging members that transfer the heat in a high-temperature part to a low-temperature part inside of the recording element substrate 2, and hence the temperature difference inside of the recording element substrate 2 can be reduced.

The present embodiment is not limited to the configuration using the beam parts 36, as long as a relation in the following expression (5) is satisfied.

$$\text{Thermal Resistance } Rth3 < \text{Thermal Resistance } Rth1 \quad (5)$$

Figure 14:
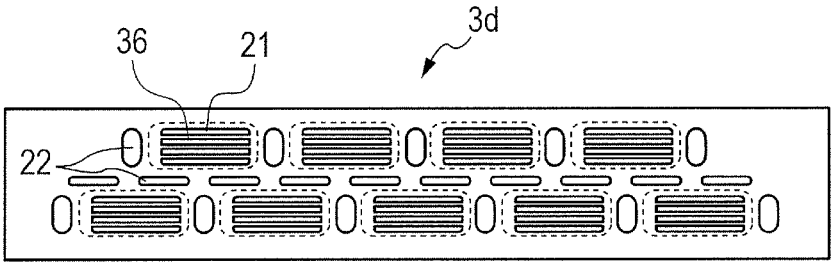
FIG. 14 is a top view illustrating a modified example of the first support member illustrated in FIG. 13A.

In the present embodiment, as a first support member 3*d* illustrated in FIG. 14, the hole parts 22 described in the first embodiment may be provided in addition to the beam parts 36.

Fourth Embodiment

Figure 15:
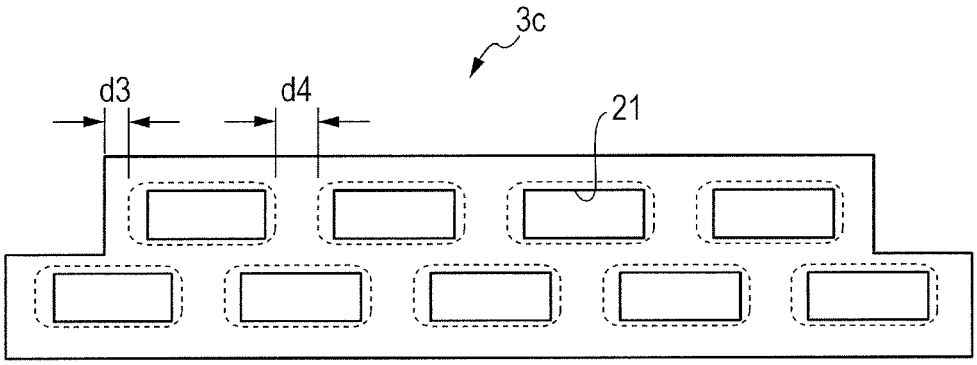
FIG. 15 is a top view of a first support member provided to a liquid ejection head of a fourth embodiment.

A fourth embodiment of the present invention is described. Hereinafter, differences from the first embodiment are mainly described. FIG. 15 is a top view of a first support member provided to a liquid ejection head of the fourth embodiment In a first support member 3*e* illustrated in FIG. 15, a distance d3: from an end of a region in which the recording element substrate 2 located at an end of the line is placed; to an end of the first support member 3*e* is equal to or less than ½ of a distance d4 between the recording element substrates.

In the above-mentioned first support members 3 to 3*d*, a radiation region of the heat generated in the end-side recording element substrate located at an end of the line is larger than radiation regions of the heat generated in the other recording element substrates. As a result, the temperature difference between the end-side recording element substrate and the other recording element substrates is expected to be large. In comparison, in the first support member 3*e* of the present embodiment, the heat radiation region of the end-side recording element substrate is made smaller so as to have the same area as the areas of the other recording element substrates, and hence the temperature difference between the end-side recording element substrate and the other recording element substrates can be reduced.

Figure 16:
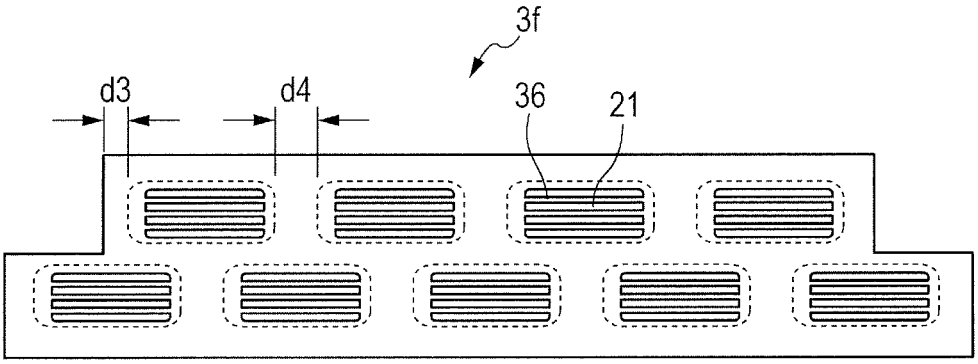
FIG. 16 is a top view illustrating a modified example of the first support member illustrated in FIG. 15.

In the present embodiment, as the first support member 3*f* illustrated in FIG. 16, the beam parts 36 described in the third embodiment may be provided. In the case of using the first support member of the present embodiment, the height of each assist plate 23 is increased by a height corresponding to the thickness of the support member 3*f* such that the FPCs 6 can be placed within a plane having a uniform height on both the first support member 3 and the assist plates 23.

EXAMPLES

Hereinafter, examples of the present invention are described. In the present examples, the liquid ejection head was connected to the liquid supply mechanism (see FIG. 8), and temperature distribution of each recording element substrate 2 when an image was recorded using each recording element substrate 2 was calculated through numerical analysis. Conditions of a recording speed, image resolution and the like are as illustrated in Table 1.

TABLE 1

| Image Size | L-Format Size |
|---|---|
| Recording Speed (Page per Minute) | 130 |
| Image Resolution (dpi) | 1200 |
| Liquid Droplet Volume (pL) | 2.8 |
| Ejection Energy (μJ/bit) | 0.45 |
| Ejection Efficiency (pL/μJ) | 6.22 |
| Regulated Temperature (° C.) | 55 |
| Liquid Circulation Amount (mL/min) | 25 |
| Liquid Supply Temperature (° C.) | 27 |
| Liquid Specific Gravity | 1.08 |

Example 1

In Example 1, the first support member 3*e* illustrated in FIG. 15 was used. In the present example, the first support member 3*e* had a thickness of 1.5 mm, and was made of alumina (heat conductivity: 24 W/m/K). The second support member 4 had a thickness of 8 mm, and was made of PPS (heat conductivity: 0.8 W/m/K). The base substrate 5 was made of alumina.

Comparative Examples 1 and 2

In Comparative Example 1, the first support member 3*e* was made of glass (heat conductivity: 1 W/m/K). In Comparative Example 2, the first support member 3*e* was made of SiC (heat conductivity: 160 W/m/K). In Comparative Examples 1 and 2, the dimensions, the shapes and the recording conditions of the recording element substrate 2, the second support member 4 and the base substrate 5 are the same as those in Example 1.

For Example 1 and Comparative Examples 1 and 2, Table 2 illustrates: the thermal resistances of the regions in the first and second support members; and whether or not the above expressions (1) and (2) are satisfied. Note that the relation in the above expression (3) is satisfied in all of Example 1 and Comparative Examples 1 and 2.

TABLE 2

| | Thermal Resistance (K/W) | | | | | |
|---|---|---|---|---|---|---|
| | First Support Member Rth1 | Second Support Member Rth2 | First Support Member Rth3 | Second Support Member Rth4 | Expression (1) | Expression (2) |
| Example 1 | 48.1 | 16.9 | 35.5 | 178.4 | ○ | ○ |
| Comparative Example 1 | 1153.6 | 16.9 | 852.7 | 178.4 | ○ | x |
| Comparative Example 2 | 7.2 | 16.9 | 5.3 | 178.4 | x | ○ |

○: The relation in one of the expression (1) and the expression (2) is satisfied.
x: The relation in one of the expression (1) and the expression (2) is not satisfied

Numerical Analysis Results of Example 1 and Comparative Examples 1 and 2

Figure 17:
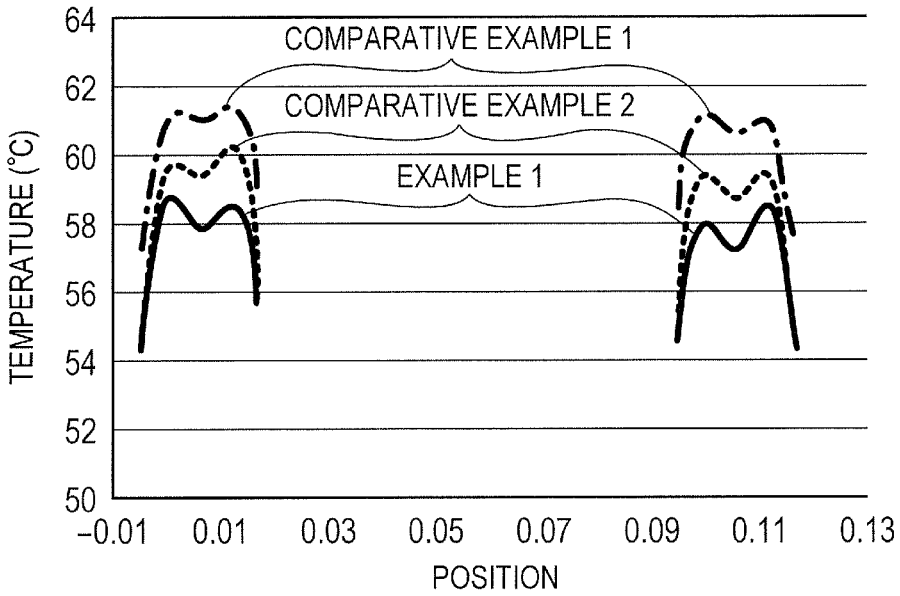
FIG. 17 is a graph illustrating temperature distribution of each recording element substrate.

FIG. 17 is a graph illustrating temperature distribution of each of the recording element substrates 2 respectively located on the most upstream side and the most downstream side in a liquid flow direction (see FIG. 7) in the common flow channel 8. In the graph illustrated in FIG. 17, the positive direction of the horizontal axis corresponds to the flow direction. The temperature of the vertical axis is calculated in the following manner. For each recording element substrate 2, a value obtained by averaging the temperatures of four ejection orifice line groups 13 having the same coordinate in the flow direction (the arrangement direction of the recording element substrates 2) is defined as the temperature at the coordinate position.

Based on the temperature distribution illustrated in FIG. 17, Table 3 illustrates: the highest one of the temperatures of the recording element substrates; and a difference (hereinafter, referred to as in-head temperature difference) between the highest temperature and the lowest temperature of each of the recording element substrates respectively located on the most upstream side and the most downstream side.

TABLE 3

| | Highest | In-head Temperature Difference (° C.) | |
|---|---|---|---|
| | Temperature (° C.) | Most Upstream Side | Most Downstream Side |
| Example 1 | 58.8 | 4.5 | 4.4 |
| Comparative Example 1 | 61.4 | 4.4 | 4.4 |
| Comparative Example 2 | 60.3 | 5.8 | 5.6 |

As illustrated in Tables 2 and 3, in Example 1 in which both the relational expressions (1) and (2) are satisfied, the highest temperature is lower than in Comparative Examples 1 and 2, and the in-head temperature difference is lower than in Comparative Example 2. Although the difference between Example 1 and each of Comparative Examples 1 and 2 is a few degrees Celsius, this temperature difference leads to a difference of as high as several percent in terms of the volume of the liquid ejected from the ejection orifices 12, and influences the image quality of a recorded image. Accordingly, the liquid ejection head of Example 1 can record a high-quality image.

Example 2

Example 2 is the same as Example 1 except that the first support member 3*f* illustrated in FIG. 16 is used. Numerical analysis was performed under the conditions illustrated in Table 1, and the obtained results were compared with the results in Example 1. The difference between Example 1 and Example 2 is whether or not the beam parts 36 are provided. As described in the third embodiment, the beam parts 36 have a function of reducing the temperature difference inside of each recording element substrate, particularly, the temperature difference in the arrangement direction of the recording element substrates 2.

Figure 18:
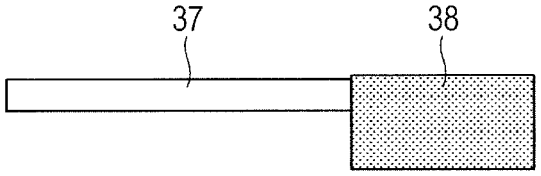
FIG. 18 illustrates an image recorded in Example 2.

FIG. 18 illustrates an image that is recorded for numerical analysis on the temperature difference inside of the recording element substrate in Example 2. In Example 2, a blacked-out belt-like image 37 is first recorded. The belt-like image 37 is formed by consecutively driving only part of the energy generating elements 15 in the recording element substrate 2. Then, the energy generating elements are uniformly driven while a recording medium is transported by a transportation unit (not illustrated) provided to the recording apparatus, whereby an image 38 is recorded. In such an ejection mode, after the belt-like image 37 is recorded, the temperature difference between a portion in which the energy generating elements 15 are driven (generate heat) and a portion in which the energy generating elements 15 are not driven (do not generate heat) is likely to occur in the recording element substrate. Hence, in the case where the first support member 3 is not sufficiently capable of averaging the heat in the recording element substrate 2, even if an image having uniform density such as the image 38 is tried to be recorded, density unevenness occurs due to the temperature difference inside of the recording element substrate.

For Example 1 and Example 2, Table 4 illustrates the maximum value of the temperature differences inside of the recording element substrate together with the thermal resistances of the regions in the first support member.

TABLE 4

| | Thermal Resistance (K/W) of First Support Member | | Maximum Value of Temperature Differences inside of |
|---|---|---|---|
| | Rth1 | Rth3 | Recording Element Substrate |
| Example 1 | 48.1 | 35.5 | 6.8 |
| Example 2 | 48.1 | 26.9 | 6.5 |

As illustrated in Table 4, in both the first support members of Examples 1 and 2, the thermal resistance Rth1 concerning the in-plane direction, of the region E between the recording element substrates is higher than the thermal resistance Rth3 concerning the in-plane direction, of the projection region F. Because the beam parts 36 are provided in Example 2, the thermal resistance Rth3 is lower in Example 2. As a result, in Example 2, the maximum value of the temperature differences inside of the recording element substrate is lower than in Example 1.

Example 3

Example 3 is the same as Example 1 except that the first support member 3 illustrated in FIG. 5 is used. Numerical analysis was performed under the conditions illustrated in Table 1, and the obtained results were compared with the results in Example 1. The difference between Example 1 and Example 3 is whether or not the relation described in the fourth embodiment that the distance d3 (see FIG. 16) is equal to or less than ½ of the distance d4 (see FIG. 16) is satisfied.

For Example 1 and Example 3, Table 5 illustrates: the temperature difference inside of the central recording element substrate located in the center of the line; and the temperature difference inside of the end-side recording element substrate located at an end of the line.

TABLE 5

| | | Temperature Difference inside of Recording Element Substrate | |
|---|---|---|---|
| | d3 ≤ ½ d4 | Central Recording Element Substrate | End-side Recording Element Substrate |
| Example 1 | ○ | 6.6 | 6.8 |
| Example 3 | x | 6.8 | 11.7 |

○: The relation of d3 ≤ ½ d4 is satisfied.
x: The relation of d3 ≤ ½ d4 is not satisfied.

As illustrated in Table 5, in Example 1 in which the above relational expression is satisfied, the temperature difference inside of the end-side recording element substrate can be reduced to substantially ½ of that in Example 3.

Figure 19:
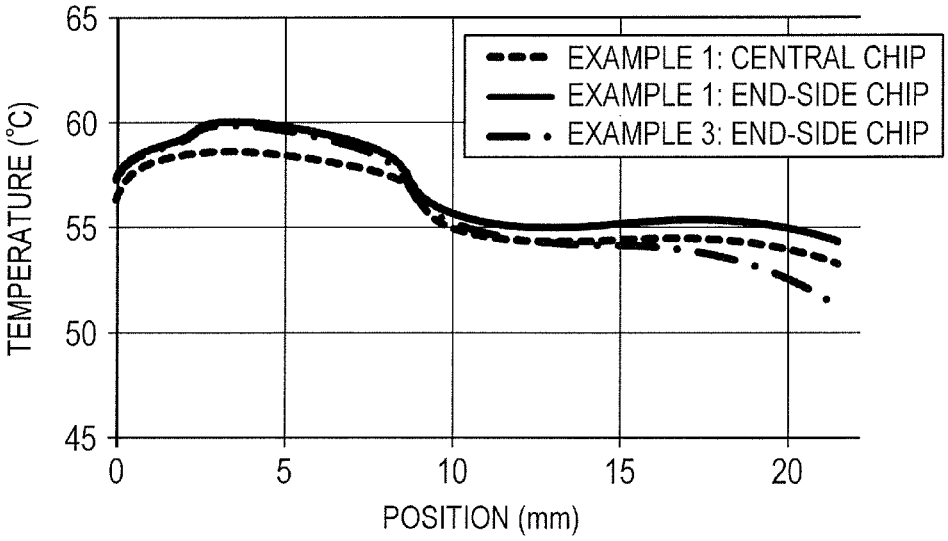
FIG. 19 illustrates temperature distribution of each of a central recording element substrate and end-side recording element substrates.

For Example 1 and Example 3, FIG. 19 illustrates temperature distribution of each of the central recording element substrate and the end-side recording element substrates. In FIG. 19, an end of each of the central recording element substrate and the end-side recording element substrates is defined as a positional reference. Example 1 and Example 3 were the same as each other in the temperature distribution of the central recording element substrate, and hence the temperature distribution of the central recording element substrate of Example 3 is omitted in FIG. 19. In FIG. 19, "CENTRAL CHIP" means the central recording element substrate, and "END-SIDE CHIP" means the end-side recording element substrate.

As illustrated in FIG. 19, heat radiation from the end-side recording element substrate is more suppressed in Example 1 than in Example 3, and hence the temperature difference inside of the end-side recording element substrate and the temperature difference inside of the central recording element substrate have values substantially equivalent to each other. That is, the temperature difference between the end-side recording element substrate and the central recording element substrate can be lower in Example 1 than in Example 3.

Hereinabove, embodiments and examples of the present invention have been described, and the present invention is not limited to the contents described above. Liquid ejection heads of line type have been described above in the embodiments and the examples, and the present invention may be applied to liquid ejection heads of so-called serial type that record images while scanning.

Thermal liquid ejection heads have been described above in the embodiments and the examples, and the present invention may be applied to piezoelectric liquid ejection heads. In the case of the piezoelectric method, temperature fluctuations in recording element substrates caused by an ejection operation are smaller than in the thermal method, and have relatively small influences on image quality. The piezoelectric method includes a shear mode method in which liquid is ejected using shear deformation of piezoelectric elements, and the shear mode method generally has low energy efficiency during the ejection (the amount of heat that does not contribute to the ejection is large). Hence, the amount of heat transferred from each recording element substrate to the first support member is large, so that the temperature difference between the recording element substrates may be large. Accordingly, if the present invention is applied thereto, the heat transfer between the recording element substrates can be suppressed, and effects similar to effects produced for the thermal liquid ejection heads can be produced.

According to the present invention, the heat conduction between the recording element substrates is suppressed, and hence the temperature difference between the recording element substrates caused along with the liquid ejection can be reduced. This can suppress variations in the amount of liquid ejected from the ejection orifices of each recording element substrate, and thus can enhance image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-034145, filed Feb. 25, 2014, which is hereby incorporated by reference herein in its entirety.

What is claimed is:

1. A liquid ejection head comprising:

a plurality of recording element substrates including energy generating elements that generate ejection energy for ejecting liquid from ejection orifices;

a first support member that supports the plurality of recording element substrates such that the recording element substrates are arranged in one or more lines on a main surface of the first support member; and a second support member that supports the first support member on a surface opposite to the main surface, wherein a first thermal resistance concerning an in-plane direction parallel to the main surface, of a region between the recording element substrates in the first support member, is higher than a second thermal resistance concerning a thickness direction of the second support member, of a projection region that overlaps with each recording element substrate in the second support member, and a third thermal resistance concerning the in-plane direction, of the projection region in the first support member, is lower than the first thermal resistance.

2. The liquid ejection head according to claim 1, wherein a hole part that penetrates through the first support member is provided in the region between the recording element substrates.

3. The liquid ejection head according to claim 1, wherein a plurality of pedestal parts for individually mounting the plurality of recording element substrates is provided for the first support member, and a distance between the pedestal parts is greater than a distance between the recording element substrates.

4. The liquid ejection head according to claim 1, wherein each recording element substrate includes a temperature sensor that detects a temperature of the recording element substrate and a heating member that heats the recording element substrate, and an operation of the heating member is controlled such that a temperature that is detected by the temperature sensor in a period in which the liquid is not ejected from the ejection orifices falls within a predetermined allowable range.

5. The liquid ejection head according to claim 1, wherein each recording element substrate includes a temperature sensor that detects a temperature of the recording element substrate, and operations of the energy generating elements are controlled such that a temperature that is detected by the temperature sensor in a period in which the liquid is not ejected from the ejection orifices falls within a predetermined allowable range.

6. The liquid ejection head according to claim 1, wherein a distance from a region in which the recording element substrate located at an end of a line in the first support member is placed to an end of the first support member is equal to or less than ½ of a distance between the recording element substrates.

7. The liquid ejection head according to claim 1, wherein the first support member includes through-holes for respectively supplying the liquid to the recording element substrates, the through-holes being respectively covered by the recording element substrates, and beam parts that extend across each through-hole.

8. The liquid ejection head according to claim 1, wherein the third thermal resistance is lower than a fourth thermal resistance concerning the in-plane direction, of the projection region in the second support member, and a contact area between the first support member and the second support member is larger than a contact area between the first support member and the recording element substrates.

9. The liquid ejection head according to claim 8, wherein a fifth thermal resistance concerning the in-plane direction of the first support member, of a region obtained by excluding the projection region from a region in which the first support member and the second support member overlap with each other, is lower than a sixth thermal resistance concerning the in-plane direction of the second support member.

10. A recording apparatus comprising a liquid ejection head, the liquid ejection head comprising:

a plurality of recording element substrates including energy generating elements that generate ejection energy for ejecting liquid from ejection orifices;

a first support member that supports the plurality of recording element substrates such that the recording element substrates are arranged in one or more lines on a main surface of the first support member; and a second support member that supports the first support member on a surface opposite to the main surface, wherein a first thermal resistance concerning an in-plane direction parallel to the main surface, of a region between the recording element substrates in the first support member, is higher than a second thermal resistance concerning a thickness direction of the second support member, of a projection region that overlaps with each recording element substrate in the second support member, and a third thermal resistance concerning the in-plane direction, of the projection region in the first support member, is lower than the first thermal resistance.

11. A heat radiation method for a liquid ejection head, comprising:

radiating heat generated in a plurality of recording element substrates including energy generating elements that generate ejection energy for ejecting liquid from ejection orifices, by a first support member that supports the plurality of recording element substrates such that the recording element substrates are arranged in one or more lines on a main surface of the first support member, and a second support member that supports the first support member on a surface opposite to the main surface; and transferring the heat from the first support member to the second support member by making such setting that a first thermal resistance concerning an in-plane direction parallel to the main surface, of a region between the recording element substrates in the first support member, is higher than a second thermal resistance concerning a thickness direction of the second support member, of a projection region that overlaps with each recording element substrate in the second support member, and a third thermal resistance concerning the in-plane direction, of the projection region in the first support member, is lower than the first thermal resistance.

* * * * *